US006126000A

United States Patent [19]

Tung

[11] Patent Number: 6,126,000

[45] Date of Patent: Oct. 3, 2000

[54] GARMENT PRESENTATION PACK

[76] Inventor: David Tung, 13B, Verdant Court, Discovery Bay, The Hong Kong Special Administrative Region of the People's Republic of China

[21] Appl. No.: 09/128,154

[22] Filed: Aug. 3, 1998

[51] Int. Cl.[7] ..... B65D 85/18

[52] U.S. Cl. ..... 206/278; 206/293; 229/87.17; 229/71; 229/72

[58] Field of Search ..... 229/87.15, 87.19, 229/87.17, 87.06, 162, 72.71; 206/278, 293, 245, 292

[56] References Cited

U.S. PATENT DOCUMENTS

| | | | |
|---|---|---|---|
| 893,666 | 7/1908 | Silvermann | 206/278 X |
| 975,911 | 11/1910 | Warren | 229/162 X |
| 989,935 | 4/1911 | Wilcox | 206/278 X |
| 1,031,252 | 7/1912 | Dorsey | 229/87.15 X |
| 1,152,240 | 8/1915 | Todd | 229/162 X |
| 1,228,714 | 6/1917 | Stortz | 206/278 X |
| 1,720,679 | 7/1929 | Karn | 229/87.15 X |
| 1,970,636 | 8/1934 | Tanner | 229/162 X |
| 1,987,751 | 1/1935 | Sahm | 229/87.15 X |
| 2,112,062 | 3/1938 | Berger | 206/278 X |
| 2,333,943 | 11/1943 | Levkoff | 229/87.06 X |
| 3,369,657 | 2/1968 | Quade et al. | 206/299 |
| 3,381,889 | 5/1968 | Laskow | 229/87.19 |
| 3,409,121 | 11/1968 | Taterka | 206/299 |
| 3,589,508 | 6/1971 | Burchett | 229/87.15 X |
| 3,784,086 | 1/1974 | Forbes, Jr. | 206/278 X |
| 4,231,509 | 11/1980 | Austin | 229/162 X |
| 4,951,815 | 8/1990 | Ulbrich | 206/213 |
| 4,955,469 | 9/1990 | Hudspith | 229/162 X |
| 5,224,499 | 7/1993 | Zayas | 206/245 X |

FOREIGN PATENT DOCUMENTS

| | | |
|---|---|---|
| 2581625 | 5/1985 | France . |
| 295436 | 2/1928 | United Kingdom . |
| 2199788 | 7/1988 | United Kingdom . |

*Primary Examiner*—Stephen P. Garbe
*Assistant Examiner*—Tri M. Mai
*Attorney, Agent, or Firm*—Jackson Walker L.L.P.

[57] ABSTRACT

A garment pack that folds to show a garment inside having a chest heart pattern and in which a sleeve logo is visible through a window in one section from inside the pack that opens like a card.

5 Claims, 3 Drawing Sheets

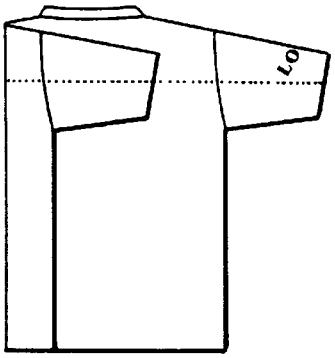
Fig. 3(iii)
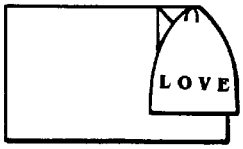
Fig. 3(vii)

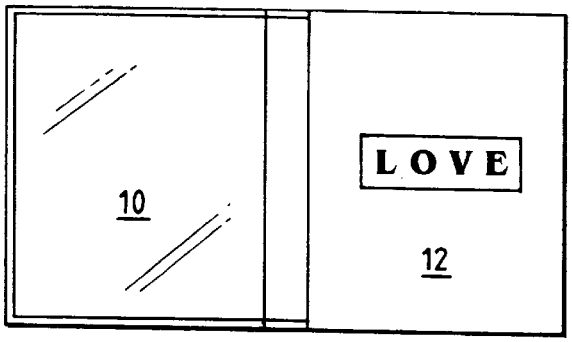
Fig. 4(iii)

GARMENT PRESENTATION PACK

BACKGROUND OF THE INVENTION

1. Field of the Invention

The invention relates to a garment presentation pack.

2. Description of Prior Art

The invention has particular although not exclusive application to a pack that comprises a greetings card at the same time. In European application EP 0220827 such a combined greetings card and gift package are described in which the garment is partially visible through an aperture in one side once the pack is closed. A similar pack is described in European Patent specification EP 0246839, having an external pocket to receive a greetings card. In the prior art it is not practical to conveniently show more than one part of the garment which is desirable for garments having decorations, messages or logos at significantly relatively displaced regions of the garment.

SUMMARY OF THE INVENTION

It is an object of the invention to overcome or at least reduce this problem.

According to the invention there is provided a pack for garments and the like comprising three like planar sections arranged to fold against one another to form the pack for containing a garment, in which in use the garment is folded up and held in a pocket provided in a first section and extends over the first section and a second central section, the first section being arranged to fold over the central section, and a third section on an opposite side of the central section to the first section being arranged to fold over the central section, in which the first section and/or the third section is at least partially transparent or apertured so that when the pack is formed distinctly different regions of the garment are visible from exterior of the pack.

The pack may have flaps along a top and a bottom edge of the central section arranged to fold inside the pack when being formed and hold the third section against the central section. The flaps preferably each have a strip of adhesive material that serves to hold the third section closed.

A small aperture may be provided in at least one of the flaps to receive and locate a clothes clip for the garment.

The first section may be formed wholly of transparent material.

The second section may be wholly or partially transparent or apertured.

BRIEF DESCRIPTION OF THE DRAWINGS

A garment pack according to the invention will now be described by way of example with reference to the accompanying drawings in which.

DESCRIPTION OF THE PREFERRED EMBODIMENTS

Figure 1:
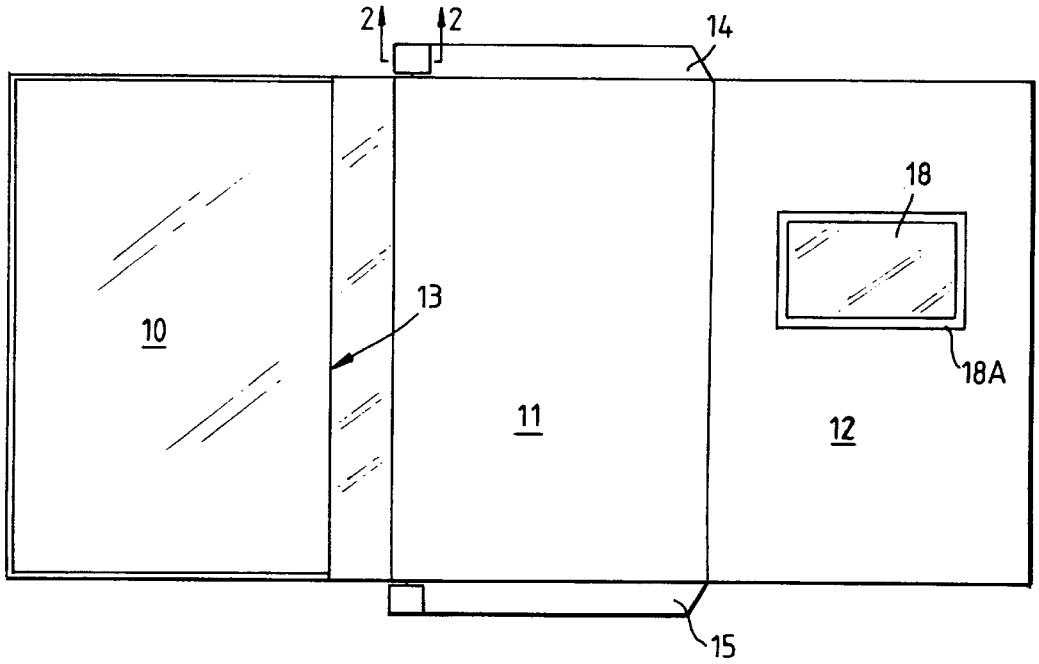
FIG. 1 shows a plan view of the inside of the pack before being folded together.
Figure 2:
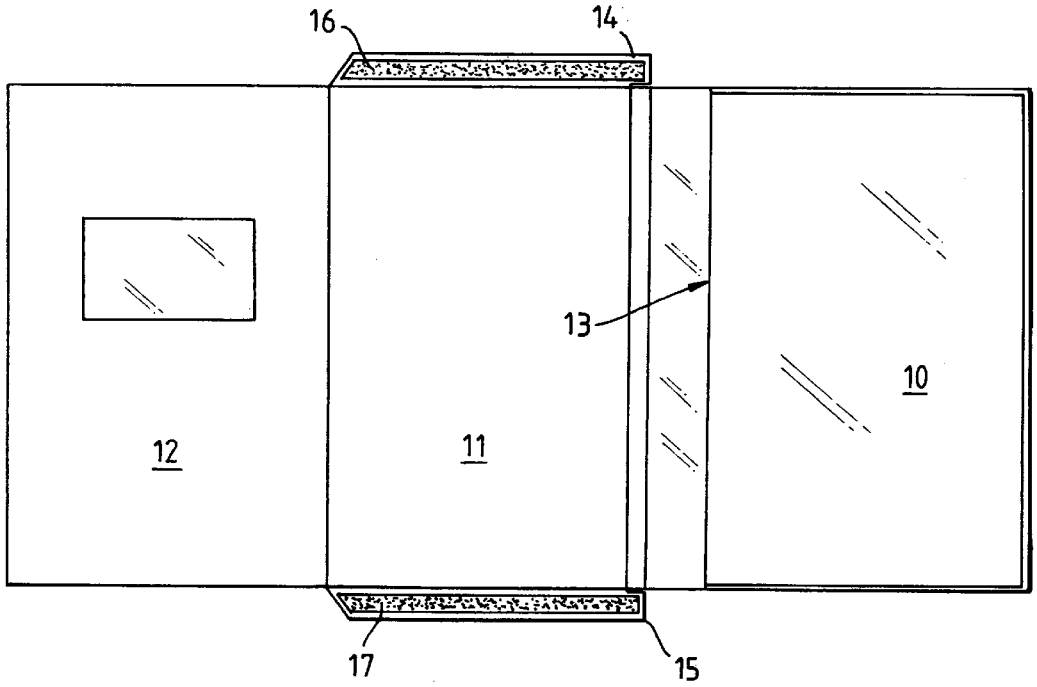
FIG. 2 shows a plan view of the outside of the pack before being folded together.

Referring to the drawings, in FIGS. 1 and 2, the pack comprises three like sections 10, 11 and 12. The first section 10 contains a pocket open at 13 to receive part of a folded garment.

The first and third sections 10 and 12 are arranged on opposite sides of the second or central section 11. The sections 10 and 12 are both arranged to fold over the section 11 to form the pack, as is described more fully below. Flaps 14 and 15 extend along the top and bottom edges of the section 11. The flaps 14 and 15 each have an adhesive strip 16 and 17 to hold the section 12 closed against the central section 11.

Figure 5:
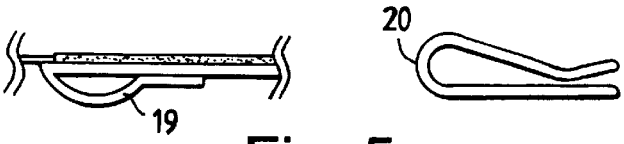
FIG. 5 shows a section 2—2 of FIG. 1 and a clothes clip.

The section 10 is formed wholly or partially of transparent material so that the garment inside the pocket remains wholly or partially visible from exterior of the pack. The section 10 may alternatively be formed of opaque material and be provided with one or more viewing windows if preferred. The section 12 is provided with a viewing window 18 (which may be covered by a transparent patch 18A) so that part of the garment is visible from exterior of the pack. There may be more than one window if desired. The flaps 14 and 15 are provided with anchors 19 as shown in FIG. 5 to receive clothes clips 20 for holding the folded garment in position in the pack.

Figure 3I:
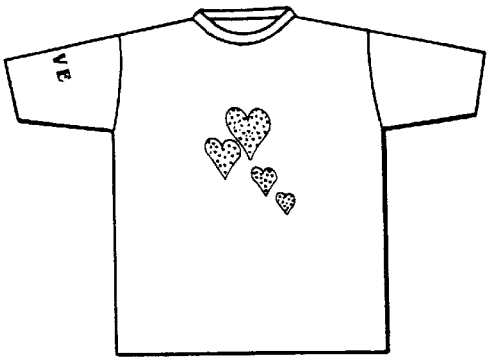
FIG. 3 shows sequential views of a garment being folded up for placing in the pack.
Figure 3:
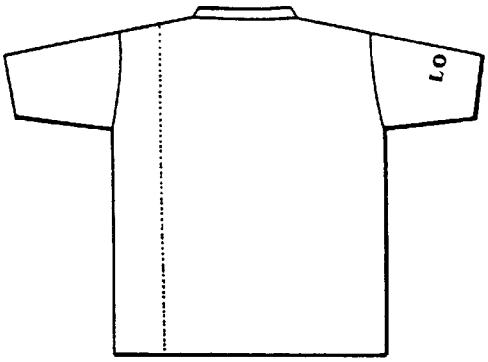
Figure 3:
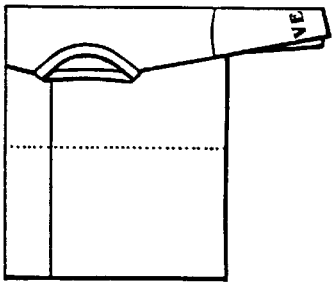
Figure 3V:
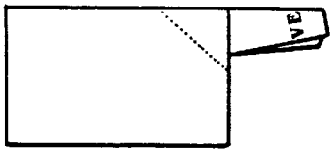
Figure 3:
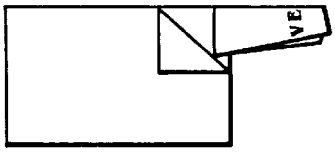

In FIG. 3, a typical garment is shown having a chest heart pattern and a sleeve logo, which are both required to be visible when the garment is held inside the pack. FIG. 3 shows a folding sequence (i) to (vii) for arranging the chest pattern and logo to be suitably disposed when the garment is folded up.

Figure 4I:
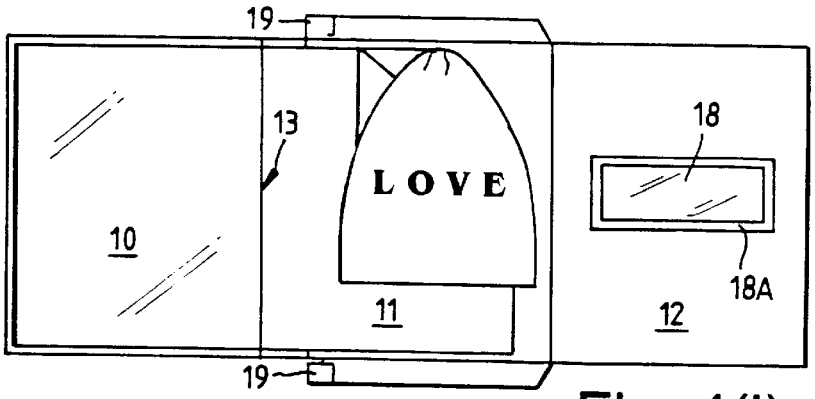
FIG. 4 shows sequential views of the pack being folded with the garment in position.
Figure 4:
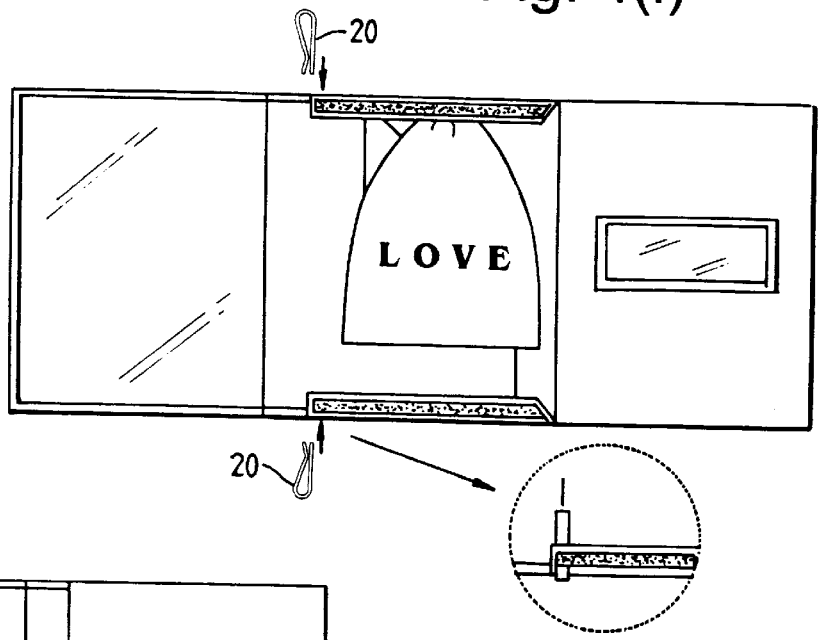
Figure 4:
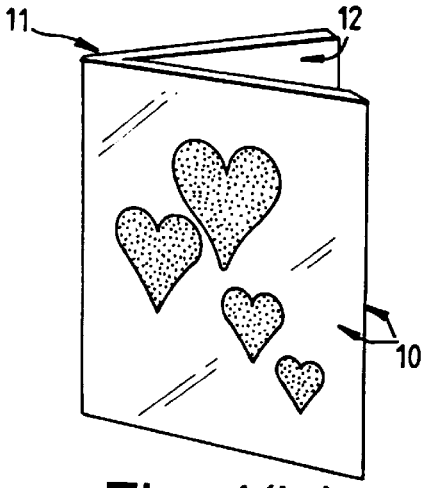

In FIG. 4, a sequence for placing the folded garment into and forming the pack is shown in sequence (i) to (iv). In (i) a main part of the garment has been slid into the pocket so that another part of the garment lies on top of the central part 11. In (ii) the flaps 14 and 15 have been turned over and the clothes clips 20 fitted to hold against the other part of the garment, and generally hold the whole of the folded up garment in position in the pack. This will normally be necessary as the garment part that lies over the central section will normally be smaller in area than the central section itself. In this respect it will be appreciated that the pocket of section 10 may be smaller in area than the total area of the section 10. Also, it is possible to add or create the pocket during the formation of the pack. That is to say, a flap or an extra section can be provided that fits over a single layered section 10, to form a suitable pocket. As such, the pocket can be created, if preferred after the folded garment has been placed against the first section in step (i), or created as a first step but just before the folded up garment is placed in the pocket.

In (iii) the third section 12 has been folded over the central section 11 and held closed by the adhesive strip 16 and 17. In (iv), the finished pack is shown and takes the form of an openable "card" where the first section has been folded over the central section and is presented as the "front" of the folded pack, or "card".

The normal front outer part therefore shows the chest pattern and the inner part of the card shows the logo when the card is opened. In this way the finished pack can be presented in the form of an otherwise conventional greetings card and carry its own printed or painted greetings or messages. At the same time, the folded up garment is appropriately held in the pack and its patterns, logos and indeed its texture are clearly visible, discernible, and easy to otherwise inspect. Importantly or effectively, a full inspection of the garment is possible without any need to remove the garment from or interfere with its location in the pack.

The central section 11 may also be made at least partially of transparent material and/or provided with one or more windows.

The described presentation pack can be used for holding and displaying chosen parts as descried, including towels and other textile materials.

Normally the windowed section 12 serves to cover the folded parts of the garment and allow display of the logo, for example, well separated relatively from chest pattern. The section 12 as described also creates a suitable positioning for a theme or common message, perhaps, to appear in the greetings card in an otherwise conventional position.

It will be appreciated that if the central section 11 is transparent or has one or more apertures, the third section 12 may be totally opaque because the garment or parts of it will then be visible through the central section, and through the first section. Thus, the pack will still enable distinctly different regions of the pack to be visible from exterior of the pack.

In general, the provision of apertures or transparent areas in the pack, is to expose the selected parts of the folded garment to allow exterior viewing. Awkward or unevenly folded regions or unwanted regions of the garment can be covered by opaque areas of the pack and so be out of sight when the pack is made up.

I claim:

1. A pack for a garment comprising first, second and third planar sections arranged to fold against one another to form said pack for containing a garment including a pocket in said first section, in which in use said garment is folded up and held in said pocket provided in said first section and extends over said first section and said second section, said first section being arranged to fold over said second section, and said third section which lies on an opposite side of said second section to said first section being arranged to fold over said second section, in which said first section and said third section have at least a portion in each said first section and said third section partially transparent so that when said pack is formed, distinctly different regions of said garment are visible from exterior of said pack; and flaps along a top and a bottom edge of said second section arranged to fold inside said pack when being formed and hold said third section against said second section, said flaps each have a strip of adhesive material that serves to hold said third section closed against said second section.

2. A pack according to claim 1, further comprising a small aperture in at least one of said flaps to receive and locate a clothes clip for said garment.

3. A pack according to claim 1 wherein said first section is formed wholly of transparent material.

4. A pack according to claim 1 wherein said second section is formed wholly of transparent material.

5. A pack according to claim 1 wherein said third section is formed with at least one viewing aperture.

* * * * *